United States Patent [19]

Cieslak et al.

[11] 4,180,922

[45] Jan. 1, 1980

[54] BOOT WARMER

[76] Inventors: Stanley Cieslak, 14, Creek Rd.; Leonard K. Cieslak, 14 Creek Rd., both of, McKees Rocks, Pa. 15136

[21] Appl. No.: 875,815

[22] Filed: Feb. 7, 1978

[51] Int. Cl.[2] ..... A43B 7/02

[52] U.S. Cl. ..... 36/2.6; 126/206; 126/263

[58] Field of Search ..... 36/2.6, 136; 126/204, 126/206, 210, 263

[56] References Cited

U.S. PATENT DOCUMENTS

| | | | |
|---|---|---|---|
| 518,579 | 4/1894 | Annenberg et al. | 36/2.6 |
| 912,527 | 2/1909 | Batter | 36/2.6 |
| 1,199,914 | 10/1916 | Mossor | 36/2.6 |
| 3,547,100 | 12/1970 | Usui | 126/206 |
| 3,572,314 | 3/1971 | Teague, Jr. | 126/210 |
| 3,737,620 | 6/1973 | Harvey | 126/204 X |
| 3,793,643 | 2/1974 | Kinoshita | 126/204 X |
| 3,874,365 | 4/1975 | Pava | 126/263 |
| 4,094,080 | 6/1978 | Sanders | 36/2.6 |

FOREIGN PATENT DOCUMENTS

| | | | |
|---|---|---|---|
| 19994 | of 1899 | United Kingdom | 36/2.6 |

*Primary Examiner*—James Kee Chi

*Attorney, Agent, or Firm*—Carothers and Carothers

[57] ABSTRACT

A boot warmer having a compact portable heater unit for burning solid fuel agglomerates. The heater unit includes a liquid reservoir in heat exchange relationship with the fuel agglomerates. A liquid conduit circulates the liquid throughout a boot or a boot liner by means of a hand manipulated pump. The heat exchanger or unit and pump are exposed and attached to the top of the boot, or in the case of a boot liner to the top of the boot liner, with the provision of means to attach the unit to the top outside of a boot casing.

3 Claims, 5 Drawing Figures

BOOT WARMER

BACKGROUND OF THE INVENTION

The present invention relates to boot warmers. Boot warmers wherein a hot liquid is circulated within a boot have been known in the past, for example as illustrated in U.S. Pat. No. 518,579 issued to Annenberg et al and in U.S. Pat. No. 1,199,914 issued to Mossor. However, such boot warmers provide no compact means for heating the fluid and further require a rather awkward operation in getting the heated fluid into the boot cavities.

U.S. Pat. No. 912,527 issued to Batter on Feb. 16, 1909 discloses a portable foot and body warmer wherein a heater unit of relatively large size is attached to the individual's belt and fluid conduit tubes pass from the individual's belt down his legs and into his shoes or boot. Hand manipulated pumps are provided at the knee level to pump or circulate the fluid throughout the conduits. However, such an apparatus is extremely cumbersome and it is also relatively impractical in this day and age, and it is rather obvious that hunters and outdoor workers would not tolerate such a large amount of paraphernalia and tubes running down the legs and about the waist.

Liquid heater units for body warming purposes which are much more compact than that illustrated in Batter U.S. Pat. No. 912,527 have been developed as may be seen in U.S. Pat. No. 3,737,620. However, this compact heater unit, while being light weight and apparently very effective is relatively complex and requires the use of nuclear fusion. The expense of such a device would clearly be beyond the reach of the average hunter or outdoor worker. In addition, this reference and the aforementioned references do not teach how any of the devices disclosed could be more conveniently and economically and compactly utilized as a boot warmer.

A principle object of the present invention is to eliminate these disadvantages of the prior art and to provide a compact boot heating system which is much more convenient and less expensive than the devices of the prior art.

SUMMARY OF THE INVENTION

The boot warmer of the present invention comprises a portable compact heater unit which includes a compact insulated case having a cavity therein and which is adapted to be opened to receive slow burning solid fuel agglomerates. The case is properly ventilated so that the fuel agglomerates will slowly burn. A liquid reservoir is also provided within the case and is positioned for heat exchange or transfer from the ignited fuel agglomerates in the cavity of the case and a liquid conduit, preferably of flexible plastic, is connected at both ends to the reservoir for circulation of the heated liquid from the reservoir through the conduit in a closed circuit. The liquid conduit circulates throughout a boot or a boot liner to be inserted within a boot casing, and a pump means is also connected to the conduit for hand manipulation to circulate the heated liquid from the reservoir through the conduit and boot. Means are also provided to secure the heater unit and pump to a boot top so that the heater unit is properly ventilated and the pump is conveniently exposed for manipulation.

The boot warmer of the present invention has the advantage that the entire unit is connected to and part of the boot or boot liner itself and there are no awkward fluid lines to be run up the pant legs of the wearer or other units to attach to other portions of the body. Everything is within one compact unit on the boot or boot liner itself.

When the boot warmer of the present invention is provided with a boot liner, such as the conventional felt boot liner, the conduit line ends for circulation of the heated liquid extend from the top of the boot liner with the heating unit and pump depending therefrom. The boot liner is then simply inserted within the conventional water impervious boot casing, and the heater unit and pump depend or hang over the top outside end of the boot casing. The heater unit and pump may then be conveniently glued, stuck or otherwise attached to the outside boot casing top, as in a pocket in the boot casing top.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
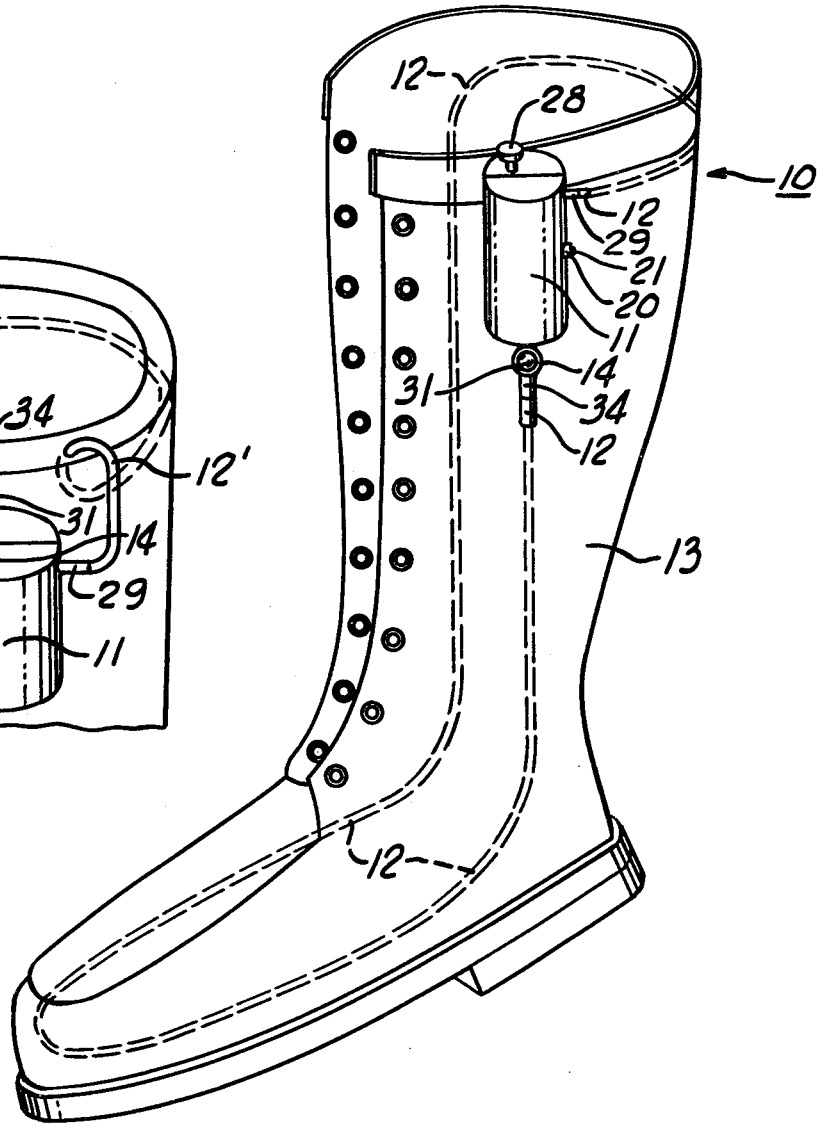
FIG. 1 is an isometric view in side elevation of the boot warmer of the present invention as utilized in a conventional boot.

Referring to FIG. 1, the boot warmer and boot combination 10 of the present invention includes a portable compact heater unit or heat exchanger 11 having a liquid conduit 12 circulating throughout and within boot 13 in order to circulate heated liquid from the heat exchanger unit 11. Heated liquid is pumped from unit 11 through conduit 12 by means of hand manipulated pump 14.

Figure 2:
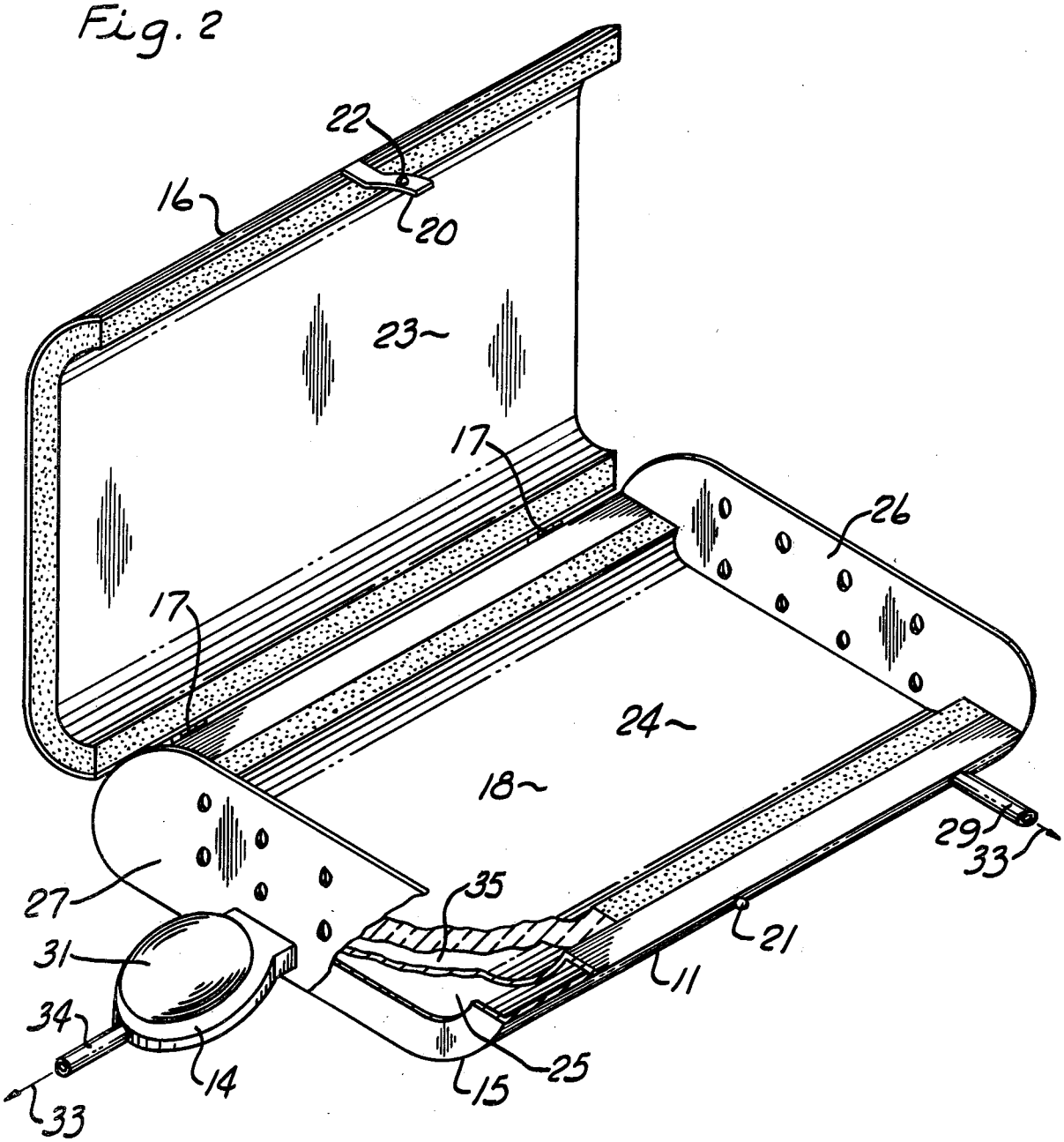
FIG. 2 is an enlarged isometric view of the heater and pump unit of the present invention with the cover of the heater case opened to expose the cavity for receiving the fuel agglomerates and with other portions removed to expose the interior of the liquid reservoir.
Figure 4:
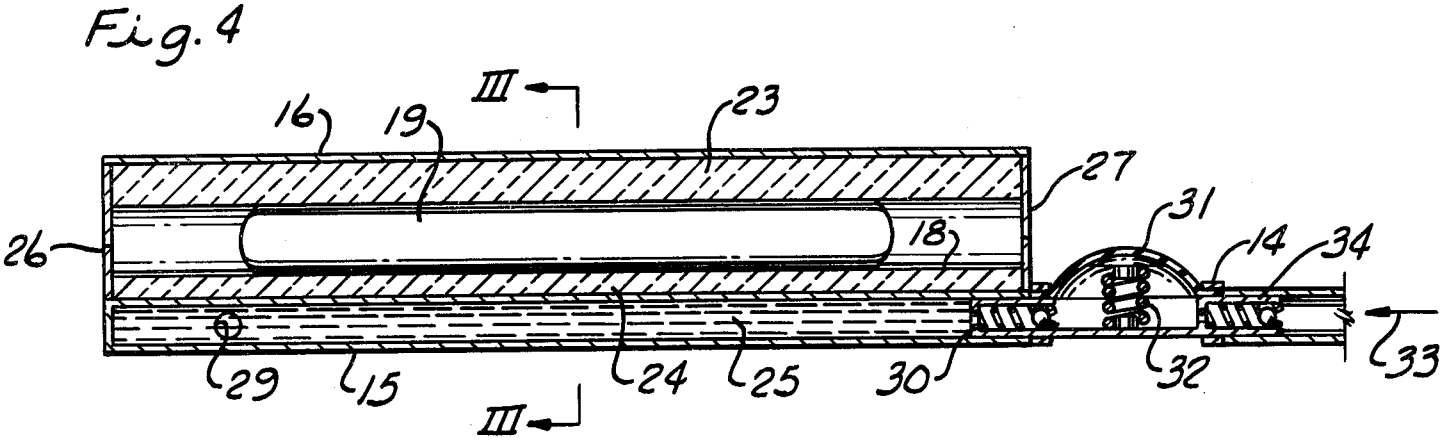
FIG. 4 is a sectional view of the heater unit illustrated in FIG. 3 as seen along section line IV—IV illustrating the interiors of the heater unit and the pump.
Figure 3:
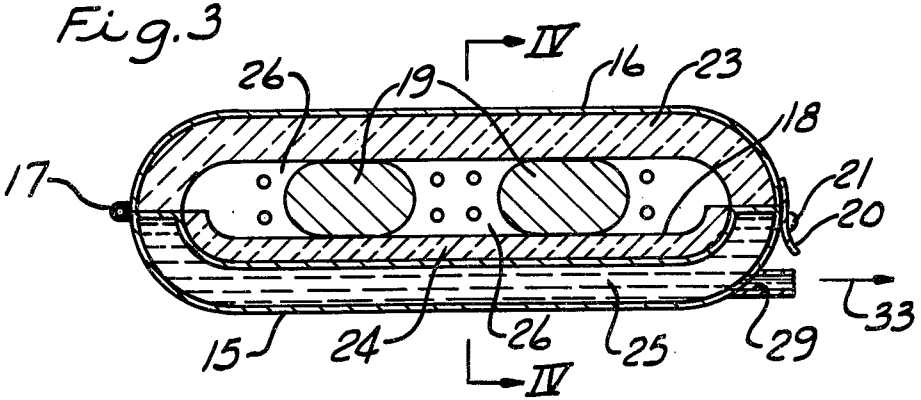
FIG. 3 is a view in mid cross section of the heater unit illustrated in FIG. 2 and as seen along line III—III with the cover closed and the solid fuel elements inserted, or as seen along section line III—III of FIG. 4.

Referring particularly to FIGS. 2, 3 and 4, heater unit 11 is relatively compact and includes a compact case 15 having a cover 16 which is hinged at 17 to the remainder of case 15 and opens as indicated in FIG. 2 to provide cavity 18 therein to receive slow burning solid fuel agglomerates 19 therein for burning. Fuel agglomerates 19 are conventional fuel agglomerates which may be purchased on the open market. One such fuel agglomerate is sold under the name of World Famous Sales Company Solid Fuel Sticks. These fuel sticks are commonly used in hand warmers.

Cover 16 is secured in its closed position as best illustrated in FIG. 3 by means of spring clip 20 which rides over and receives projection 21 within slot 22.

Cavity 18 is insulated by means of insulation 23 in cover 16 and insulation 24 in the bottom of cavity 18. This insulation may be any conventional insulation such as fiberglas matting and insulation sheet 23 is slightly thicker than insulation sheet 24. Insulation sheet 23 prevents undue loss of heat to the exterior. Center insulation sheet 24 in the bottom of cavity 18 is utilized to prevent solid fuel stick 19 from overheating or superheating the liquid contained in reservoir 25. If the fuel sticks 19 were permitted to directly contact the metal back wall 35, which is the heat exchange wall for the liquid reservoir 25, hot spots could be readily generated and the liquid contained therein could be overheated. It is generally desirable to maintain the heat of the liqid is reservoir 25 to be about 130° F.

Case 15 is provided with a perforated top 26 and a perforated bottom 27 which are welded to the main body of the case. The perforations in top and bottom walls 26 and 27 provide adequate ventilation and oxygen supply for the slow burning solid fuel agglomerates 19.

The entire case 15, with the exception of insulation 23 and 24 contained therein, is manufactured of a suitable metal such as chrome plated steel. As is best illustrated in FIG. 1, a filler spout 28 is provided at the top of the case 15 and provides access to liquid reservoir 25 for initially filling the reservoir with a suitable heat transfer liquid such as antifreeze, or a combination of water and antifreeze. Filler opening 28 is provided with a suitable plug.

Reservoir 25 is provided with an outlet 29 and an inlet 30. Head pump 14 is secured to the bottom of case 15 by means of the outlet tube 30 which penetrates into reservoir 25. Hand pump 14 is a conventional double check valve pump having a flexible diaphragm 31 which is pumped or depressed by one's finger against the resistance of return coil spring 32 to pump liquid through pump 14 as indicated by arrows 33.

The inlet of pump 14 is indicated at 34 and conduit 12 is connected at one end to inlet 34 with a force fit and at the other end with a force fit over hot liquid discharge or outlet 29.

The entire heater unit 11 together with pump 14 which is secured thereto, are attached to the boot top as indicated in FIG. 4 by any conventional means such as a pocket or an adhesive. In FIG. 1, the entire unit is attached with an adhesive and the connection of conduit 12 to the unit also assists in holding it in position.

In order to operate the boot warmer of the present invention, antifreeze or other suitable liquids are poured into the system of reservoir 25 and conduit 12 by means of filler opening 28. While doing this, pump 14 is manipulated to fully circulate the liquid being poured into the system throughout the conduit and to purge air from the system back out through filler inlet 28. Once the system is filled, one or two fuel sticks 19 are ignited at one end thereof by a match and the ignited fuel sticks are laid in cavity 18 as illustrated in FIGS. 3 and 4 and cover 16 is snapped shut and the boots are ready to wear in cold weather.

The wearer can manipulate pump 14 every 15 minutes to half hour, or as desired, to circulate heated liquid in reservoir 25 through conduit 12 thereby warming the interior of boot 13.

The entire unit and combination boot and heater unit are very compact and the boot warmer of the present invention does not interfere with the normal activity of the boot wearer and requires no tubes or anything else attached elsewhere on the person of the wearer.

Figure 5:
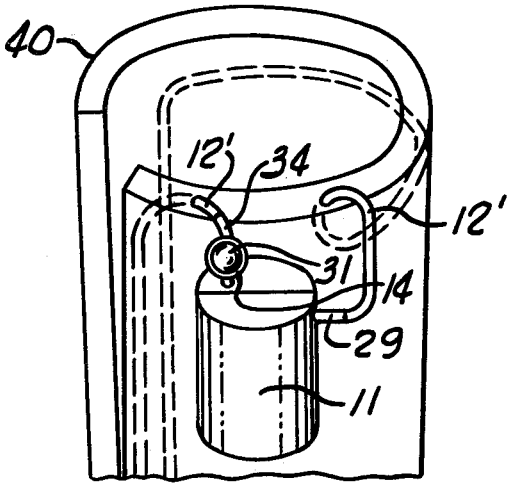
FIG. 5 is an isometric view of a felt boot liner in section with the heat exchanger or heater unit and pump assembly of the present invention installed to the top thereof.

As illustrated in FIG. 5, the boot warmer of the present invention may be provided in combination with a boot liner 40 with conduit 12' circulating throughout the boot liner 40. Felt boot liner 40 is of the conventional type which is inserted within a water impervious boot casing such as indicated at 13 in FIG. 1. Thus, the felt liner and boot warmer combination may be sold as a separate unit and inserted into a wearer's existing boot casing.

The conduit 12' exits from the top of felt boot liner 40 so that the boot liner may be conveniently inserted within a boot casing and then the heater unit 11 hangs over top of the outside boot casing and may be secured thereto by a pocket on the outside of the boot casing or any other conventional securing means such as an adhesive or an expansion strap or belt strap.

In either situation, the heater unit 11 is exposed for proper ventilation and pump 14 is also exposed for easy access and manipulation as required.

In order to fill the system illustrated in FIG. 5 with the heat transfer liquid, one need only remove conduit 12' from either outlet 29 or inlet 34 and fill the device through the opening or a separate filler opening may be provided as is the case with the unit illustrated in FIG. 1.

We claim:

1. A footwear warmer comprising a portable compact heater unit including a compact insulated case having a cavity therein and adapted to be opened to receive slow burning solid fuel agglomerates in said cavity for combustion, a liquid reservoir in said case positioned for heat transfer from ignited fuel agglomerates in said cavity, a flexible liquid conduit having both ends thereof connected for circulation of the heated liquid from said reservoir through said conduit in a closed circuit adapted for circulation of heated liquid from said reservoir within a unit of footwear, pump means connected to said conduit for hand manipulation to circulate heated liquid from said reservoir through said conduit on demand, and means to secure said heater unit to a boot top with said pump manipulation means exposed for hand manipulation.

2. A boot and boot warmer combination comprising a portable compact heater unit including a compact insulated case having a cavity therein and adapted to be opened to receive a slow burning solid fuel agglomerate in said cavity for burning, a liquid reservoir in said case positioned for heat transfer from an ignited fuel agglomerate in said cavity, a boot, means to secure said heater unit to said boot at the top thereof, a liquid conduit circulating within said boot and having both ends thereof connected for circulation of heated liquid from said reservoir through said conduit in a closed circuit, pump means connected to said conduit and exposed adjacent the top of said boot for hand manipulation to circulate heated liquid from said reservoir through said conduit on demand.

3. The boot and boot warmer combination of claim 2 wherein said boot consists of a boot liner for insertion into a water impervious boot casing.

* * * * *